United States Patent [19]

Abri

[11] Patent Number: 5,030,804

[45] Date of Patent: Jul. 9, 1991

[54] CONTACT ARRANGEMENT FOR ELECTRIC SWITCHING DEVICES

[75] Inventor: Assadollah Abri, Västerås, Sweden

[73] Assignee: Asea Brown Boveri AB, Västerås, Sweden

[21] Appl. No.: 515,582

[22] Filed: Apr. 27, 1990

[30] Foreign Application Priority Data

Apr. 28, 1989 [SE] Sweden ..... 8901551

[51] Int. Cl.[5] ..... H01H 1/52; H01H 1/22; H01H 75/00; H01H 3/00

[52] U.S. Cl. ..... 200/323; 200/244; 200/248; 335/16; 335/147; 335/195

[58] Field of Search ..... 200/318, 321, 322, 323, 200/324, 325, 244, 248; 335/195, 147, 16

[56] References Cited

U.S. PATENT DOCUMENTS 4,039,983 8/1977 Terracol et al. ..... 335/16
4,649,247 3/1987 Preuss et al. ..... 200/244
4,910,485 3/1990 Mobleu et al. ..... 335/195

FOREIGN PATENT DOCUMENTS 2157927 5/1973 Fed. Rep. of Germany .
2845950 4/1980 Fed. Rep. of Germany .

*Primary Examiner*—Henry J. Recla
*Assistant Examiner*—Antoine Gamarra
*Attorney, Agent, or Firm*—Watson, Cole, Grindle & Watson

[57] ABSTRACT

The invention relates to a contact arrangement, particularly intended for current-limiting low-voltage circuit breakers, with a double-break movable contact arm, the central part of which is attached to an insulating shaft which is rotatably journalled in elongated holes in stand parts on each side of the contact arm. In the closed position of the arrangement, the movable contact arm is pressed against two U-shaped fixed contact arms with the aid of two torsion springs. The contact arms have flat shape and are arranged with their broad sides facing each other. The shaft consists of two sleeve-formed holders surrounding the torsion springs. One holder exhibits a stop face for a latching member for arresting the movable contact arm in the open position.

7 Claims, 1 Drawing Sheet

CONTACT ARRANGEMENT FOR ELECTRIC SWITCHING DEVICES

TECHNICAL FIELD

The present invention relates to a contact arrangement, intended for electric switching devices, of the kind comprising a double-break movable contact arm, the central part of which is attached to a shaft which is rotatably journalled in bearing holes in stand parts on either side of the contact arm, the contact arm being rotatable between a closed and a open position and being arranged to be pressed in the closed position with the aid of contact pressure springs against two fixed contact arms which are each aranged at a respective end of the movable contact arm, the movable contact arm having an elongated cross-section and being arranged with its largest cross-sectional dimension substantially perpendicular to the plane of rotation. The invention is primarily related to contact arrangements for current-limiting circuit breakers for rated operating voltages of up to about 1000 V, but, in principle, it may be used also for other types of low-voltage switching devices.

BACKGROUND ART

An electric switching device with rotatably journaled movable contacts and two series-connected breaking points per pole is previously known from DE-A-2 845 950. In this switching device the movable contact is attached together with the contact pressure springs in a diametrically through-going hole in a shaft of insulating material. This hole must be sufficiently large to accommodate the spring movement of the contact. For this reason the shaft must have a relatively large diameter, which entails a relatively large mass of the movable system. This is a disadvantage, especially in current-limiting circuit breakers, since the larger movable mass gives lower contact acceleration upon breaking, which reduces the breaking capacity.

In a contact device of a similar kind disclosed in EP-B-0 174 904, in which a double-break movable contact arm has a central bearing arrangement, the movable contact arm exhibits an elongated bearing hole, the longitudinal axis of which is directed perpendicular to the longitudinal axis of the contact arm. This enables the contact arm to be displaced, within certain limits, transversely in the plane of rotation so that approximately the same contact pressure is achieved at the two breaking points, independently of manufacturing tolerances, contact wear, etc. Furthermore, the movable contact arm is formed with stop faces for two catches which constitute parts of a coupling shaft. A drawback with this design is that the movable contact will have large cross-sectional dimensions in the plane of rotation in relation to the dimension perpendicular thereto. This means that the electrodynamic repulsion force, which influences the movable contact arm upon a short circuit, becomes lower than in contact arms which have their main extension perpendicular to the plane of rotation, since the distance between the anti-parallel current lines in the contact arms becomes larger. This results in slower contact separation and reduced breaking capacity.

SUMMARY OF THE INVENTION

The object of the present invention is to provide a contact arrangement of the above-mentioned kind, particularly intended for current-limiting circuit breakers, which does not suffer from the drawbacks mentioned. This is achieved according to the invention by a contact arrangement which is characterized in that the bearing holes, arranged in the stand, for the shaft of the movable contact arm are elongated and oriented such that the movable contact arm can be displaced transversely in the plane of rotation, and that the shaft exhibits a stop face for a latching member for arresting the movable contact arm in the open position. Since the contact arms are of flat shape and face each other with their flat sides, high electrodynamic repulsion forces will occur, which entails a rapid contact separation upon a short circuit. Since the bearing holes, provided in the stand, for the shaft of the movable contact arm are elongated and oriented such that the movable contact arm can be displaced transversely in the plane of rotation, the further advantage is achieved that the contact forces at the two series-connected contact points are at least approximately equally great. By arranging stop faces for latching members, etc., on the shaft fixed at the movable contact arm and not on the contact arm itself, as in the prior art embodiment described above, a simpler contact arm is achieved which facilitates and makes contact replacements less expensive.

The shaft for the movable contact arm suitably consists of one or two substantially cylindrical, sleeve-formed holders with fixing slots for fixing the holders on the contact, the holders being arranged on each side of the contact. These holders may suitably accommodate the contact pressure springs formed as torsion springs, which, inter alia, results in the advantage that the springs lie protected against metal spatter from the contact points.

BRIEF DESCRIPTION OF THE DRAWING

The invention will be explained in greater detail with reference to an embodiment shown in the accompanying drawing, wherein.

DESCRIPTION OF THE PREFERRED EMBODIMENT

Figure 1:
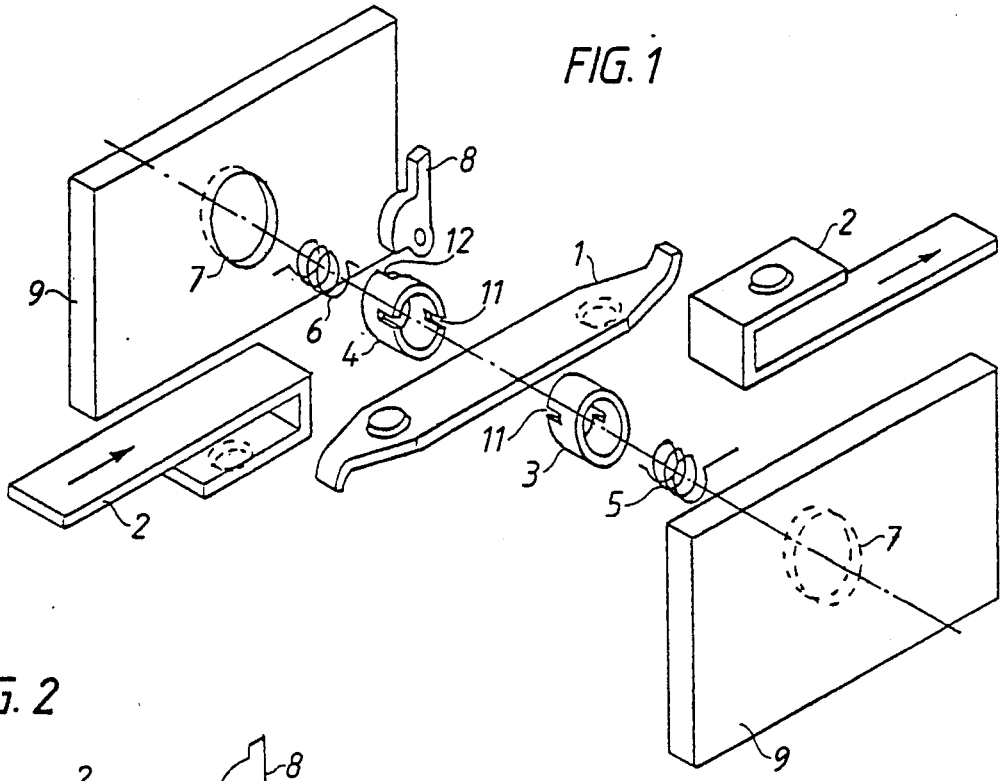
FIG. 1 is an exploded perspective view of a contact arrangement according to the invention, FIG. 2 schematically shows the configuration of the current path of this contact arrangement.
Figure 2:
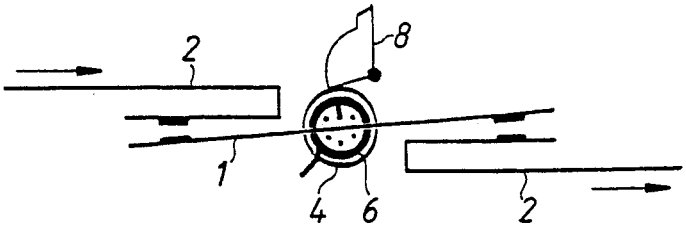

The contact arrangement shown in FIGS. 1 and 2 comprises a double-break movable contact arm 1, the central part of which is attached to a shaft consisting of two substantially cylindrical, sleeve-formed holders 3, 4 of a suitable plastic material, the holders being coaxially arranged on either side of the movable contact arm. The shaft 3, 4 is journaled in bearing holes 7 in the stand part 9 on either side of the movable contact arm and is rotatable between a closed and an open position. In the closed position the movable contact arm is pressed with the aid of two torsion springs 5, 6 against two U-shaped fixed contact arms 2, which are each arranged at a respective end of the movable contact.

Figure 3:
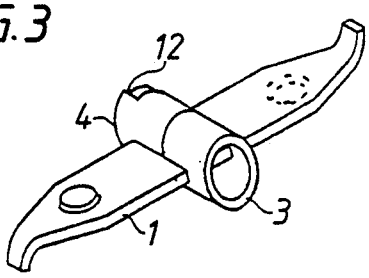
FIG. 3 shows in perspective the movable contact arm of the contact arrangement with a shaft mounted thereon, FIG. 4 schematically shows the bearing arrangement of the shaft, and FIG. 5 schematically shows, in the same way as FIG. 2, an alternative embodiment of the contact arrangement.

The two holders 3, 4 which form the shaft of the movable contact arm are provided, at the end surfaces facing the contact arm, with diametrical slots 11 in which the contact arm 1 is fixed (FIG. 3). The fixing of the movable contact arm in the axial direction in the holders 3, 4 may, for example, be achieved by providing, in the center of the narrow sides of the contact arm along a distance corresponding to the diameter of the holders, for example 0.5 mm deep recesses (e.g. by milling or punching), in which the holders engage.

One of the holders, 4, exhibits a stop face 12 for a spring-loaded latching member 8, which engages and retains the movable contact arm in the open position when the contact distance exceeds a predetermined value.

The two torsion springs 5, 6 are each housed in a respective one of the sleeve-shaped holders 3, 4. The springs are fixed with one end to the respective holders 3, 4 and with the other end to the respective side wall 9.

Figure 4:
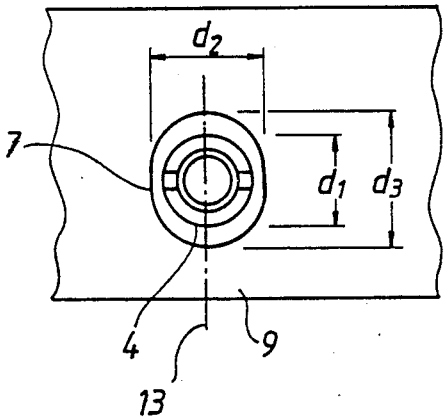

As will be clear from FIG. 4, those bearing holes 7 for the holders 3, 4 which are arranged in the side walls 9 are elongated and oriented such that the longitudinal axis 13 of the respective hole is parallel to a line directed approximately perpendicular to the longitudinal axis of the movable contact arm 1. The largest transverse dimension $d_3$ of the holes is considerably larger than their smallest transverse dimension $d_2$ which, in turn, is somewhat larger than the diameter $d_1$ of the holders 3,4. With this embodiment the advantage is achieved that the movable contact arm is, in principle, self-adjusting so that approximately the same contact force arises at the two series-connected contact points, independently of, for example, uneven contact wear.

Figure 5:
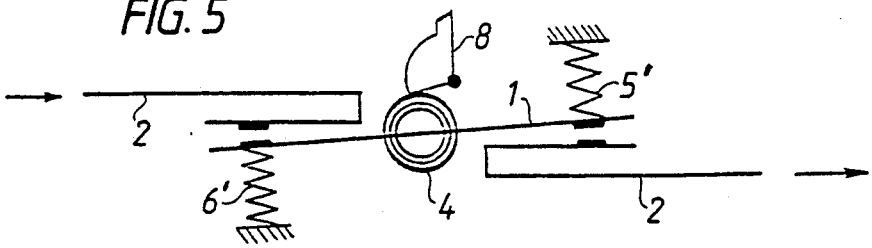

The contact pressure springs need not necessarily consist of torsion springs but may instead consist of, for example, compression springs wound in the form of spiral springs 5', 6' as shown in FIG. 5.

When a short-circuit current flows through the contact arrangement shown, the movable contact arm, because of the configuration of the fixed current paths and the flat shape of the contact arms which gives a short distance between the antiparallel current lines, will be influenced by strong electrodynamic repulsion forces. In this way a rapid contact separation and an efficient limitation of the short-circuit current are attained.

The invention is not limited to the embodiment shown but can be materialized in many different ways within the scope of the claims. For example, the shaft 3, 4 need not necessarily consist of two parts but can be designed as one integrated part.

I claim:

1. A contact arrangement for electric switching devices, comprising:

a stand comprising two stand parts separated from one another and each provided with aligned bearing holes elongated in a first direction;

a shaft extending between said stand parts and rotatably journaled in said bearing holes, said shaft exhibiting a stop face;

two fixed contact arms extending perpendicularly to said first direction and spaced from each other between said stand parts;

a double-break movable contact arm extending between said fixed contact arms and having as central part attached to said shaft, said movable contact arm being rotatable between a closed position in which it is in contact with said fixed contact arms and an open position in which it is separated from said fixed contact arms; said movable contact arm having an elongated cross-section and positioned with its largest cross-sectional dimension substantially perpendicular to its plane of rotation and being oriented in relation to said elongated bearing holes such that the movable contact arm can be displaced in said first direction in said plane of rotation;

contact pressure springs for urging said movable contact arm against said fixed contact arms in said closed position; and a latching member journaled in said stand and cooperating with said stop face for arresting the movable contact arm in said open position.

2. A contact arrangement according to claim 1, in which the fixed contact arms are U-shaped.

3. A contact arrangement according to claim 1, in which the shaft is made of insulating material.

4. A contact arrangement according to claim 1, in which the shaft consists of two substantially cylindrical, sleeve-shaped holders, arranged on each side of the movable contact arm, the end surface of said holders facing the movable contact arm having diametrical fixing slots adapted to the cross-sectional dimensions of the contact arm.

5. A contact arrangement according to claim 1, in which the contact pressure strips consist of torsion springs which are enclosed in the shaft for the movable contact arm.

6. A contact arrangement according to claim 2, in which the shaft consists of two substantially cylindrical, sleeve-shaped holders, arranged on each side of the movable contact arm, the end surfaces of said holders facing the movable contact arm having diametrical fixing slots adapted to the cross-sectional dimensions of the contact arm.

7. A contact arrangement according to claim 2, in which the contact pressure springs consist of torsion springs which are enclosed in the shaft for the movable contact arm.

* * * * *